United States Patent [19]

Simpson et al.

[11] Patent Number: 4,631,094

[45] Date of Patent: Dec. 23, 1986

[54] METHOD OF PROCESSING A NICKEL/TITANIUM-BASED SHAPE MEMORY ALLOY AND ARTICLE PRODUCED THEREFROM

[75] Inventors: John A. Simpson, Mountain View; Keith Melton, Cupertino; Tom Duerig, Fremont, all of Calif.

[73] Assignee: Raychem Corporation, Menlo Park, Calif.

[21] Appl. No.: 668,771

[22] Filed: Nov. 6, 1984

[51] Int. Cl.[4] ..... C22F 1/10; C22F 1/00

[52] U.S. Cl. ..... 148/11.5 F; 148/11.5 N; 148/402

[58] Field of Search ..... 148/402, 421, 426, 442, 148/133, 11.5 F, 11.5 N; 420/451, 417, 580

[56] References Cited

U.S. PATENT DOCUMENTS

| | | | |
|---|---|---|---|
| 3,740,839 | 6/1973 | Otte et al. | 29/628 |
| 3,748,197 | 7/1973 | Willson | 148/131 |
| 3,753,700 | 8/1973 | Harrison et al. | 148/402 |
| 3,948,688 | 4/1976 | Clark | 148/131 |
| 3,953,253 | 4/1976 | Clark | 148/131 |
| 4,035,007 | 7/1977 | Harrison et al. | 420/580 |
| 4,036,669 | 7/1977 | Brook et al. | 148/11.5 C |
| 4,067,752 | 1/1978 | Brook et al. | 148/11.5 R |
| 4,095,999 | 1/1978 | Brook et al. | 148/11.5 R |
| 4,149,911 | 4/1979 | Clabburn | 148/11.5 R |
| 4,198,081 | 4/1980 | Harrison et al. | 420/580 |
| 4,205,293 | 5/1980 | Melton et al. | 337/140 |
| 4,283,233 | 8/1981 | Goldstein | 148/11.5 R |

FOREIGN PATENT DOCUMENTS

| | | | |
|---|---|---|---|
| 53-108012 | 9/1978 | Japan | 148/402 |
| 0697600 | 11/1979 | Japan | 148/11.5 N |

OTHER PUBLICATIONS

U.S. patent application, "Nickel/Titanium Vanadium Shape Memory Alloy", by Mary P. Quin, filed Oct. 14, 1983, U.S. Ser. No. 541,844.

U.S. patent application, "Nickel/Titanium Copper Shape Memory Alloy", by John D. Harrison, filed Sep. 29, 1983, U.S. Ser. No. 537,316.

Transformation Pseudoelasticity and Deformation Behavior in a Ti-50.6 at % Ni Alloy by S. Miyazaki et al., in Scripta Metallurgica, vol. 15, pp. 287-292, 1981, Pergamon Press Ltd, U.S.A.

Military Specification—Fittings, Tube, Fluid Systems, Separable, Dynamic Beam Seal, General Requirements for MIL-F-85421, Feb. 11, 1981, U.S. Government Printing Office 1981—703 023 1155, p. 1-20.

*Primary Examiner*—L. Dewayne Rutledge
*Assistant Examiner*—Deborah Yee
*Attorney, Agent, or Firm*—Ira David Blecker

[57] ABSTRACT

There is disclosed a method of processing a nickel/-titanium-based shape memory alloy. The method comprises overdeforming the alloy so as to cause at least some amount of nonrecoverable strain, temporarily expanding the transformation hysteresis by raising the austenite transformation temperature, removing the applied stress and then storing the alloy at a temperature less than the new austenite transition temperature. There is also disclosed an article produced from this method.

56 Claims, 6 Drawing Figures

METHOD OF PROCESSING A NICKEL/TITANIUM-BASED SHAPE MEMORY ALLOY AND ARTICLE PRODUCED THEREFROM

RELATED APPLICATION

This application is related to U.S. Ser. No. 668,777 filed even date herewith and entitled "Nickel/Titanium/Niobium Shape Memory Alloy and Article" which is incorporated herein by reference.

BACKGROUND OF THE INVENTION

This invention relates to the field of processes suitable for producing a nickel/titanium-based shape memory alloy and a shape memory alloy article.

Materials, both organic and metallic, capable of possessing shape memory are well known. An article made of such materials can be deformed from an original, heat-stable configuration to a second, heat-unstable configuration. The article is said to have shape memory for the reason that, upon the application of the heat alone, it can be caused to revert or attempt to revert from its heat-unstable configuration to its original heat-stable configuration, i.e., it "remembers" its original shape.

Among metallic alloys the ability to possess shape memory is a result of the fact that the alloy undergoes a reversible transformation from an austenitic state to a martensitic state with a change of temperature. Also, the alloy is considerably stronger in its austenitic state than in its martensitic state. This transformation is sometimes referred to as a thermoelastic martensitic transformation. An article made from such an alloy, for example, a hollow sleeve, is easily deformed from its original configuration to a new configuration when cooled below the temperature at which the alloy is transformed from the austenitic state to the martensitic state. The temperature at which this transformation begins is usually referred to as $M_s$ and the temperature at which it finishes $M_f$. When an article thus deformed is warmed to the temperature at which the alloy starts to revert back to austenite, referred to as $A_s$ ($A_f$ being the temperature at which the reversion is complete), the deformed object will begin to return to its original configuration.

Commercially viable alloys of nickel and titanium have been demonstrated to have shape-memory properties which render them highly useful in a variety of applications.

Shape-memory alloys have found use in recent years in, for example, pipe couplings (such as are described in U.S. Pat. Nos. 4,035,007 and 4,198,081 to Harrison and Jervis), electrical connectors (such as are described in U.S. Pat. No. 3,740,839 to Otte and Fischer), switches (such as are described in U.S. Pat. No. 4,205,293 to Melton and Mercier), etc., the disclosures of which are incorporated herein by reference.

It is, of course, advantageous to have the alloy austenitic at the service temperature which is often but not necessarily near room temperature, since the austenite phase is stronger than the martensite phase. In fact, it would be desirable to have the alloy remain austenitic over a wide range of service temperatures, for example from substantially below room temperature to substantially above room temperature, so that the alloy has practical utility.

As an illustration, Military Specification MIL-F-85421 requires a product that is functional to about −55° C. If the product comprises a shape memory alloy, then for convenience in shipping the product in the heat-unstable configuration, the product should not recover prior to about 50° C. It is a matter of commercial reality, within and without the military, that the product satisfy these requirements.

It is also desirable that the alloy be martensitic in the vicinity of room temperature so that the article can be fabricated, stored, and shipped at or near room temperature. The reason for this is that in the case of an article made from the alloy, a coupling, for example, the article would not recover prematurely.

Conceptually, one way to achieve these desirable results, to wit, an alloy that is martensitic near room temperature and which is also austenitic over a large range of temperatures including room temperature, is to have an alloy which exhibits a sufficiently wide tranformation hysteresis, say, greater than about 125° C. If the hysteresis were sufficiently wide and room temperature could be located near the middle of the hysteresis, then the alloy could be fabricated and conveniently stored while in the martensitic condition. Since the hysteresis is sufficiently wide, the alloy would not transform to austenite until heated substantially above room temperature. This heating would not be applied until the alloy (in the form of a coupling, for example) was installed in its intended environment. The alloy, which would then be in the austenitic condition, would remain in the austenitic condition after cooling down since the service temperature (which may be above or below room temperature) would be substantially above the martensite transformation temperature. Thus, the above-noted desirable results could be achieved.

Unfortunately, there is believed to be no commercially viable nickel/titanium-based alloy that has a hysteresis sufficiently wide to achieve these desirable results.

For example, the commercially viable near equiatomic binary nickel-titanium alloys can have a hysteresis width of about 30° C. The location of the hysteresis for this alloy is also extremely composition sensitive so that while the hysteresis can be shifted from sub-zero temperatures to above-zero temperatures, the width of the hysteresis does not appreciably change. Thus, if the alloy were martensitic at room temperature, the service temperature must be above room temperature. Similarly, if the service temperature was at room temperature, the alloy would be martensitic below room temperature so that the alloy would require special cold-temperature equipment for fabrication, shipping, and storage. Ideally, as discussed above, room temperature should be located near the middle of the transformation hysteresis. However, since the width of the hysteresis in the binary alloy is so narrow, the range of service temperatures for any particular alloy is necessarily limited. As a practical matter, the alloy would have to be changed to accommodate any change in service temperatures.

It can be appreciated that the relative lack of commercialization of shape memory alloys must be due, at least in part, to their extreme sensitivity to temperatures as discussed above. Alloying and processing have not solved the problem.

Nickel/titanium/iron alloys, e.g., those in Harrison et al., U.S. Pat. No. 3,753,700, while having a wide hysteresis, up to about 70° C., are the typical cryogenic alloys which always undergo the martensite/austenite transformation at sub-zero temperatures. It should be noted that in general, the colder shape-memory alloys such as the cryogenic alloys have a wider transformation hysteresis than the warmer shape memory alloys. In the case of the cryogenic alloys, the alloys must be kept very cold, usually in liquid nitrogen, to avoid the transformation from martensite to austenite. This makes the use of shape memory alloys inconvenient, if not uneconomical.

The nickel/titanium/copper alloys of Harrison et al., U.S. patent application No. 537,316, filed Sept. 28, 1983, and the nickel/titanium/vanadium alloys of Quin, U.S. patent application Ser. No. 541,844, filed Oct. 14, 1983, are not cryogenic but their hysteresis may be extremely narrow (10°–20° C.) such that their utility is limited for couplings and similar articles.

The problems experienced with the nickel/titanium-based shape memory alloys have been somewhat overcome by processing in the copper-based shape memory alloys. It is now known that the hysteresis in copper-based shape memory alloys can be temporarily expanded by mechanical preconditioning, austenitic aging and heat treating. In this regard, see Brook et al., U.S. Pat. Nos. 4,036,669; 4,067,752; and 4,095,999.

The methods of the Brook et al. patents have been applied to nickel/titanium-based alloys; however, it has been found that these methods have no beneficial effect on nickel/titanium-based alloys.

It is known that under certain conditions the hysteresis of nickel/titanium-based alloys can be shifted as opposed to expanded. It should be understood that shifting of the hysteresis means that the $M_s$, $M_f$, $A_s$, and $A_f$ temperatures have all been translated to $M_s'$, $M_f'$, $A_2'$ and $A_f'$ such that there is substantially no change in the width of the hysteresis. It should be noted that the translated transformation temperatures may be higher or lower than the normal transformation temperatures. On the other hand, expansion of the hysteresis should generally be understood to mean that $A_s$ and $A_f$ have been elevated to $A_s'$ and $A_f'$ while at least $M_s$ and usually also $M_f$ remain essentially constant. Aging, heat treatment, composition, and cold work can all effectively shift the hysteresis. For example, if the stress is applied to the shape memory alloy at room temperature the hysteresis may be shifted so that the martensite phase can exist at a temperature at which there would normally be austenite. Upon removal of the stress, the alloy would isothermally (or nearly isothermally) transform from martensite to austenite.

Miyazaki et al., ("Transfomation Pseudoelasticity and Deformation Behavior in a Ti-50.6 at % Ni Alloy", *Scripta Metallurgica,* vol. 15, no. 3, pp. 287–292, (1981) have studied the deformation behavior of binary nickel-titanium alloys. As implied in FIG. 3 of this reference, the austenite transformation temperatures can be elevated when nonrecoverable strain is imparted to the alloy. That is, when the alloy was strained to 8% or higher and the stress then removed, there was some component of the strain which remained at the deformation temperature of 243 ° K. (compared to an $A_f$ of 221 ° K.). This component recovered when heated to 373 ° K. (see dotted lines on FIG. 3) although the precise recovery temperature was never measured. It is not clear from this reference whether the hysteresis was shifted or expanded since the binary nickel-rich alloy tested is extremely unstable when rapidly quenched as was done in this reference. In fact, one skilled in the art would have concluded that the hysteresis was shifted and not expanded due to the unstable alloy tested. There is no illustration of the transformation hysteresis to contradict this conclusion.

In the Melton et al. patent previously mentioned, a nickel/titanium/copper alloy was deformed beyond a critical strain so as to impart nonrecoverable strain. However, no expansion of the transformation hysteresis was observed.

While it can be appreciated that it would be desirable to have a nickel/titanium-based shape memory alloy and article with a sufficiently wide transformation hysteresis, the prior art has thus far remained silent on a way to achieve it.

Thus, it is an object of the invention to have a nickel/titanium-based shape memory alloy and article with a wide transformation hysteresis.

It is another object of the invention to process a nickel/titanium-based shape memory alloy and article so as to temporarily enlarge the transformation hysteresis of the alloy and article.

These and other objects of the invention will become apparent to those skilled in the art after reference to the following description considered in conjunction with the accompanying drawings.

BRIEF DESCRIPTION OF THE INVENTION

This invention relates to a method of processing a nickel/titanium-based shape memory alloy. The purpose of the method is to temporarily raise the $A_s$ and $A_f$ temperatures $A_s'$ and $A_f'$, respectively. This method has been found useful in fabricating shape memory alloy articles such as couplings.

DETAILED DESCRIPTION OF THE INVENTION

Figure 1:
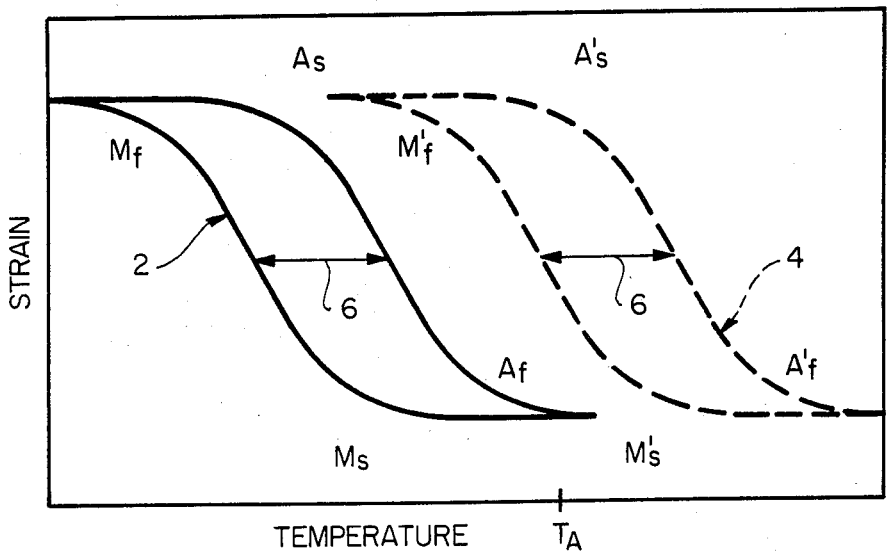
FIG. 1 is a schematical illustration of the shifting of the shape memory alloy transformation hysteresis.
Figure 2:
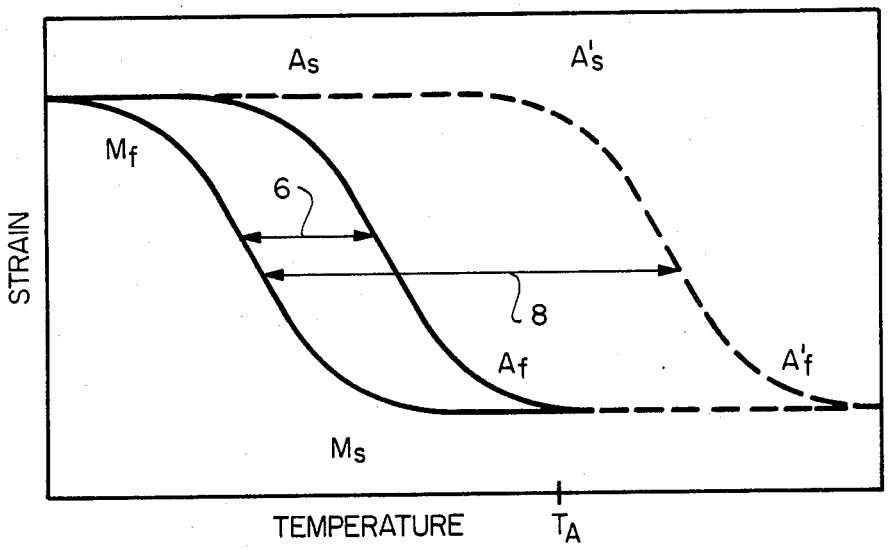
FIG. 2 is a schematical illustration of the expansion of the shape memory alloy transformation hysteresis according to the invention.

Referring to the figures in more detail and particularly referring to FIGS. 1 and 2, there is graphically illustrated the transformation hysteresis for a shape memory alloy. FIG. 1 illustrates the shifting of the transformation hysteresis as would occur if, for example, a stress was applied. The hysteresis has moved upwardly in temperature from position 2 to position 4, shown in dotted lines. While the entire hysteresis has moved upwardly in temperature it can be seen that the width of the hysteresis, indicated generally by 6 has remained approximately constant. In other words, $M_s$, $M_f$, $A_s$, and $A_f$ have all been translated to higher temperatures and are now denoted as $M_s'$, $M_f'$, $A_s'$, and $A_f'$. Of course, as stated earlier, there are circumstances where the transformation temperatures may be translated to lower temperatures.

In contrast to the shifting of the hysteresis as illustrated in FIG. 1, FIG. 2 now illustrates in general the expansion of the hysteresis. It can be seen that the martensite transformation temperatures remain constant but the austenite transition temperatures have been translated upwardly so that the width of the hysteresis indicated generally by 6 has now been expanded as indicated generally by 8. That is, $M_s$ and $M_f$ remain constant or nearly constant while $A_s$ and $A_f$ have been translated to higher temperatures and are now denoted as $A_s'$ and $A_f'$.

The advantages of temporarily expanding the hysteresis versus shifting the hysteresis can be explained as follows. Referring again to FIG. 1, a coupling may be expanded and held in the expanded condition so as to temporarily raise, i.e., temporarily shift, the hysteresis. As long as the stress is applied, the hysteresis will be shifted. If it is desired, for example, to use this coupling in ambient temperature, indicated by $T_A$, the coupling will not transform to form to austenite as long as temperature $T_A$ is below $A_s'$. Upon the removal of the stress, the coupling will isothermally (or nearly isothermally) transform into austenite. In other words, the coupling will be at $T_A$ when the stress is removed but the hysteresis will have shifted from position 4 back to position 2. The coupling being martensitic before the shift from position 4 to position 2 must necessarily be austenitic after the shift. This method may be used for constrained storage (see, e.g., Clabburn, U.S. Pat. No. 4,149,911) wherein a coupling is expanded and then held on a mandrel in the expanded condition until it is ready to be used, at which time it is cooled to below the $M_s$ temperature so that it may be released from the mandrel and then installed. The problem with this method is that while the coupling is held (during shipping, for example) in the expanded position which is necessary to shift the hysteresis, the coupling may relax so that a certain, perhaps very substantial, amount of recovery motion will be permanently lost.

Referring now to FIG. 2 it can be seen that by temporarily widening the hysteresis, as long as the coupling is held at a $T_A$ less than $A_s'$ there will be no transformation. Since no stress need be continually applied to the coupling to widen the hysteresis, relaxation is not a problem. Upon use, the coupling would simply be heated above $A_s'$, transformation from the martensite to the austenite would occur, and the hysteresis would then shrink back down to its former position.

According to the invention there is disclosed a method of processing a nickel/titanium-based shape memory alloy having a transformation hysteresis defined by $M_s$, $M_f$, $A_s$, and $A_f$ temperatures. In general, the method comprises temporarily expanding the transformation hysteresis by elevating the $A_s$ and $A_f$ temperatures to $A_s'$ and $A_f'$, respectively, so that the temperature difference between $A_s'$ and $M_s$ is greater than the temperature difference between $A_s$ and $M_s$. The means for expanding the transformation hysteresis may be removed and then the alloy is stored at a temperature less than $A_s'$.

Usually, according to the invention, both the $M_s$ and $M_f$ temperatures will remain essentially constant during the expansion of the hysteresis. However, in certain alloys, as will become apparent hereafter, either or both of the $M_s$ and $M_f$ temperatures may permanently change. This change may result from the varying of the slope or even movement of the martensitic part of the transformation hysteresis curve due to the interaction of certain metallurgical conditions. However, the important point to emphasize here is that there will always be a net increase of the width of the transformation hysteresis according to the method of the invention.

The means for expanding the transformation hysteresis comprises overdeforming the alloy by applying a stress sufficient to cause nonrecoverable strain in the alloy. It should be understood that nonrecoverable strain means strain which is not recovered after deformation and subsequent no-load heating to at least the $A_f'$ temperature.

It is important to understand and appreciate that the current practice in forming shape memory alloys as is well known to one skilled in the art is to void any nonrecoverable strain. The reason for avoiding any nonrecoverable strain is that the presence of nonrecoverable strain tends to reduce the amount of motion upon recovery. It has been found, however, that the amount of lost motion is relatively small when compared to the enhanced utility of shape memory alloys having an expanded transformation hysteresis according to the present invention.

It is preferred that a stress is applied sufficient to cause at least 1% or more of nonrecoverable strain in the alloy. Usually (but not necessarily) after the alloy is overdeformed the stress will be removed.

It is necessary to the invention that the overdeforming takes place at a temperature which is less than about the maximum temperature at which martensite can be stress-induced. To those skilled in the art this temperature is commonly known as $M_d$. It is preferred however that the overdeforming temperature be above $M_s$.

Once the hysteresis has been expanded at least partial recovery of the alloy article can occur when the alloy is heated to a temperature greater than about $A_s'$. By heating to at least $A_s'$ the transformation of the martensite to the austenite can effectively begin. It is preferred however that the heating temperature be greater than $A_f'$ so as to effect full recovery of the alloy.

It has been found that the nickel/titanium-based shape memory alloy may be a binary or it can be at least a ternary. If it is a ternary nickel/titanium-based shape memory alloy the ternary consists essentially of nickel, titanium and at least one other element selected from the group consisting of iron, cobalt, vanadium, aluminum, and niobium. The most preferred ternary, for reasons which will become apparent hereafter, consists essentially of nickel, titanium, and niobium.

It has also been found that those shape memory alloys having an $M_s$ less than about 0° C. are preferred since these alloys have the most utility and best performance.

The advantages of the invention will become more apparent after reference to the following examples.

EXAMPLE 1

Commercially pure titanium and carbonyl nickel were weighed in proportions so as to give a composition of 50.7 atomic percent nickel and 49.3 atomic percent titanium. The total mass for test ingots was about 330 grams. These metals were placed in a water-cooled, copper hearth in the chamber of an electron beam melting furnace. The chamber was evacuated to $10^{-5}$ Torr and the charges were melted and alloyed by use of the electron beam.

The resulting ingots were hot swaged and hot rolled in air at approximately 850° C. to produce a strip of approximately 0.025-in. thickness. Samples were cut from the strip, descaled and vacuum annealed at 850° C. for 30 minutes and furnace cooled. The strip was then elongated. After elongation the stress was removed and the strip was heated unrestrained so as to effect recovery of the shape memory alloy. The recovery was monitored and plotted as a function of temperature. When the transformation was complete, the sample was cooled and then reheated so as to complete the measurement of the martensite and austenite transformation temperatures before recovery and after recovery. The results are tabulated below in Table 1.

The measure $A_s'$ minus $M_s$ is very useful since $M_s$ is directly indicative of the lower functional limit of the alloy and $A_s'$ is directly indicative of the highest temperature which may be encountered (e.g., during storing and shipping) before the austenite transformation will effectively begin. Thus, $A_s'$ minus $M_s$ defines the operating range of the alloy when processed according to the invention. This measure should be compared to $A_s$ minus $M_s$ which defines the operating range of the alloy after the temporary expansion of the hysteresis has been recovered. $A_s$ minus $M_s$ is also indicative of the operating range of the alloy if it were never processed according to the invention. Thus, comparing $A_s'$ minus $M_s$ to $A_s$ minus $M_s$ provides useful indicia of the expansion of the hysteresis as well as the advantages of the invention.

Referring now to Table 1, $A_s'$ minus $M_s$ and $A_s$ minus $M_s$ are about the same at 5% elongation; however, at 16% elongation, the difference becomes substantial. It is useful to note that $A_s'$ after 16% elongation is above normal room temperature so that the alloy may now be handled at room temperature without the necessity of providing a cold environment.

Another useful measurement for indicating the expansion of the hysteresis are the $M_{50}$, $A_{50}$, and $A_{50}'$ values. These are the martensite and austenite transformation temperatures at which the transformation is 50% complete. Thus, referring to Table 1 it can be seen that the difference between $M_{50}$ and $A_{50}$, the permanent width of the hysteresis is about 60° C.

TABLE 1

| Nickel/Titanium Binary (50.7/49.3) | | |
|---|---|---|
| | % Elongation* | |
| | 5 | 16 |
| $A_s'$, °C. | 5 | 32 |
| $A_{50}'$, °C. | 12 | 39 |
| $A_f'$, °C. | 16 | 50 |
| $M_s$, °C. | −32 | −30 |
| $M_{50}$, °C. | −52 | −52 |
| $M_f$, °C. | −71 | −80 |
| $A_s$, °C. | 0 | −15 |
| $A_{50}$, °C. | 8 | 8 |
| $A_f$, °C. | 13 | 32 |
| $A_{50}'$—$M_{50}$, °C. | 64 | 91 |
| $A_{50}$—$M_{50}$, °C. | 60 | 60 |
| $A_s'$—$M_s$ | 37 | 62 |
| $A_s$—$M_s$ | 32 | 15 |

*elongated at −50° C.

However, the width of the hysteresis may be temporarily enlarged, i.e., $A_{50}'$ minus $M_{50}$, from 64° C. at 5% elongation (at which there is no nonrecoverable strain) to 91° C. at 16% elongation (at which there is substantial nonrecoverable strain). The $M_{50}$, $A_{50}$, and $A_{50}'$ values are also useful because they are the most easily determined as will become apparent hereafter.

Figure 3:
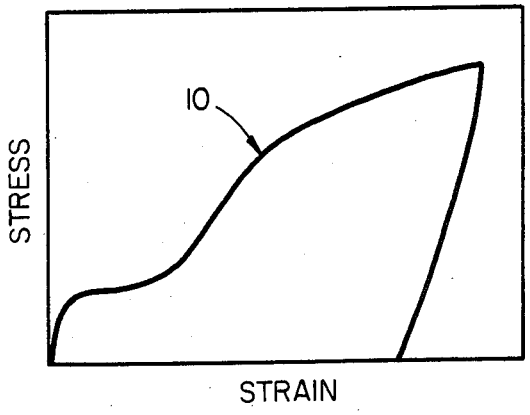
FIG. 3 is a schematical stress/strain curve for a binary nickel/ titanium-based shape memory alloy.
Figure 4:
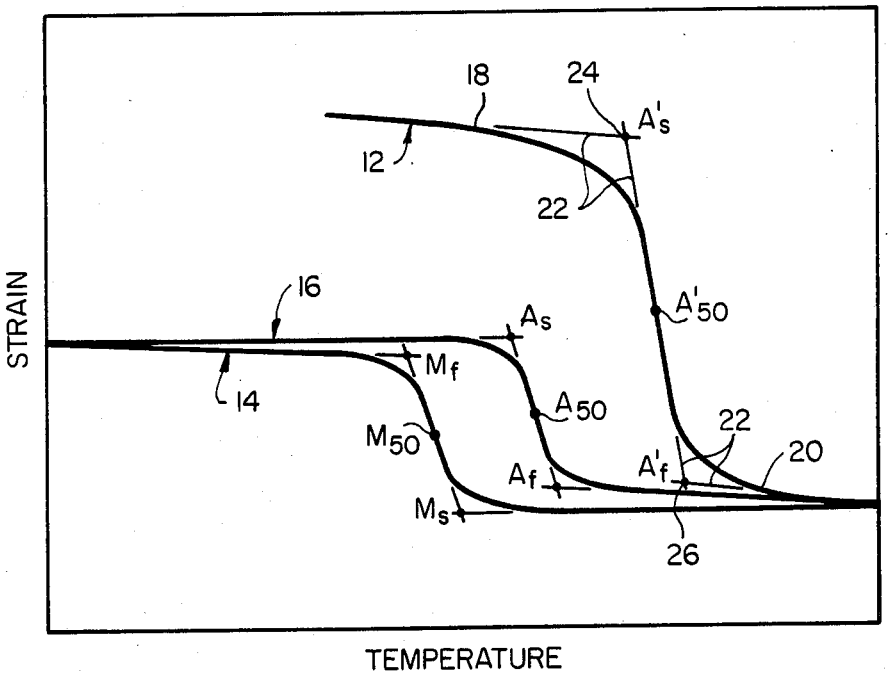
FIG. 4 schematically illustrates the binary alloy strained as in FIG. 3 in the unrecovered and recovered state.

These results are graphically illustrated in FIGS. 3 and 4. FIG. 3 illustrates a stress/strain curve for the binary alloy which was strained to 16%. The load was then removed. With 16% strain there is a substantial amount of nonrecoverable strain imparted to the alloy. Nonrecoverable strain will occur when the alloy, generally speaking, is strained past its second yield point indicated approximately by reference numeral 10. After removal of the stress, the alloy was heated.

In FIG. 4, curve 12 illustrates the heating after the removal of the stress. When the transformation was complete, the alloy was cooled down as illustrated by curve 14. During the cooling down under a small load the $M_s$ and $M_f$ temperatures were measured. The alloy was then reheated (curve 16) to measure the recovered austenite transition temperatures $A_s$ and $A_f$.

There is more than one way to locate on a transformation hysteresis curve the martensite and austenite transformation temperatures. Referring again to FIG. 4, the literal starting and ending of the austenite transformation may be indicated, for example, by points 18 and 20, respectively, on curve 12. However, the austenite transformation effectively begins at about point 24 (denoted as $A_s'$) and the austenite transformation effectively ends at about point 26 (denoted as $A_f'$). Thus it can be said that the bulk of the transformation occurs between $A_s'$ and $A_f'$. The same is true for the other transformations as illustrated by curves 14 and 16. The effective austenite and martensite transformation temperatures may be conveniently determined by the intersection of tangents to the transformation hysteresis curves. For example, tangents 22 on curve 12 locate $A_s'$ and $A_f'$. The mid-point of the transformation, for example $A_{50}'$ on curve 12, is simply vertically equidistant from the literal starting and ending points, for example 18 and 20 on curve 12, of the transformation Whenever the austenite and martensite transformation temperatures are mentioned in this specification, it should be understood that these temperatures refer to the austenite and martensite transformation temperatures determined by the above-noted method of intersecting tangents.

Curves 14 and 16 represent the shape memory alloy transformation hysteresis in the recovered state while curves 12 and 14 represent the shape memory alloy transformation hysteresis in the unrecovered state. Thus it can be seen that the elongation of the alloy according to the invention has substantially and temporarily widened the hysteresis.

In sum, the expansion of the hysteresis will facilitate the convenient handling and shipping of the alloy. This particular binary alloy would now be more suitable for a variety of applications and temperatures where the service temperature is above room temperature.

EXAMPLE 2

Commercially pure titanium, carbonyl nickel and iron were weighed in proportions so as to give a composition of 47 atomic percent nickel, 50 atomic percent titanium and 3 atomic percent iron. The total mass for test ingots was about 330 grams. These alloys were melted in an electron beam furnace in the same manner as the nickel-titanium binary. The resulting ingots were hot swaged at approximately 850° C. Round, tensile bars (¼" in diameter) were then machined from the hot swaged ingot, vacuum annealed at 850° C. for 30 minutes, and then furnace cooled.

The tensile bars were then elongated. After elongation the stress was removed and the bars were heated so as to effect recovery of the ternary shape memory alloy in the same manner as the binary alloy. Due to the extreme low temperatures involved, some of the values had to be extrapolated as noted. The results are tabulated below in Table 2.

The discrepancy in the martensite and austenite transformation temperatures (between 5 and 16% elongation) can be explained in part by the interference of the R phase, to be discussed in more detail later.

As it can be appreciated, the width of the hysteresis and the operating range have been enlarged as a result of the 16% elongation of the alloy. The import of this is that after elongation of the alloy, the alloy no longer has to be stored in liquid nitrogen to prevent it from transforming into austenite. Since $A_s'$ has been raised to −88° C. other forms of cold storage may now be used to store and ship the nickel/titanium/iron alloy prior to its final use.

TABLE 2

Nickel/Titanium/Iron Ternary (47/50/3)

| | % Elongation* | |
|---|---|---|
| | 5 | 16 |
| $A_s'$, °C. | −127 | −88 |
| $A_{50}'$, °C. | −124 | −77 |
| $A_f'$, °C. | −122 | −66 |
| $M_s$, °C.[b] | −186 (−156) | −180 (−150) |
| $M_{50}$, °C.[b] | −200 (−170) | −187 (−157) |
| $M_f$, °C.[b] | [a] | −194 (−164) |
| $A_s$, °C.[b] | −147 (−117) | −130 (−100) |
| $A_{50}$, °C.[b] | −142 (−112) | −118 (−88) |
| $A_f$, °C.[b] | −132 (−102) | −104 (−74) |
| $A_{50}'$—$M_{50}$, °C. | 76 | 110 |
| $A_{50}$—$M_{50}$, °C. | 58 | 69 |
| $A_s'$—$M_s$ | 59 | 92 |
| $A_s$—$M_s$ | 39 | 50 |

*elongated in liquid nitrogen (−190° C.)
[a]not measurable (below liquid nitrogen)
[b]values are extrapolated to no load from values measured at 20 ksi load in parentheses It is believed that this will result in greater utility of the alloy.

EXAMPLE 3

Commercially pure titanium, carbonyl nickel and niobium were weighed in proportions so as to give a composition of 47 atomic percent nickel, 44 atomic percent titanium, and 9 atomic percent niobium. The total mass for test ingots was about 330 grams. The composition was melted in an electron beam furnace as was the case with the alloys in Examples 1 and 2. The resulting ingots were hot swaged in air at approximately 850° C. The resulting bar was machined into rings which were vacuum annealed in 850° C. for 30 minutes and then furnace cooled. The rings were then enlarged, unstressed and subsequently heated so as to measure the free recovery of the alloy. The results are tabulated below in Table 3.

It can be seen from Table 3 that the hysteresis width ($A_{50}$-$M_{50}$) in the fully recovered state is about 55° C. with $A_s$ being −56° C. With the austenite temperature in this range it is still necessary for the alloy to be cold stored in order to prevent transformation of the martensite into the austenite. However, if the ring is now enlarged about 5%, the $A_s$ temperature has been temporarily raised to −14° C. which would still require cold storage. By enlarging the ring 12.1% at which point there is now substantial nonrecoverable strain, the $A_s$ has been temporarily increased to 27° C. Thus, at this temperature the alloy may be stored and shipped at room temperature. No cold storage provisions are required.

TABLE 3

Nickel/Titanium/Niobium Ternary (47/44/9)

| | % Enlargement | | | | | | |
|---|---|---|---|---|---|---|---|
| | 5.2[a] | 12.1[a] | 16.2[a] | 16.2[b] | 16.2[c] | 16.0[d] | 16.2[e] |
| $A_s'$, °C. | −14 | 27 | 41 | 50 | 54 | 34 | 55 |
| $A_{50}'$, °C. | −6 | 29 | 45 | 53 | 58 | 50 | 58 |
| $A_f'$, °C. | 3 | 32 | 49 | 56 | 61 | 67 | 60 |
| $M_s$, °C. | −90 | −90 | −90 | −90 | −90 | −90 | −90 |
| $M_{50}$, °C. | −95 | −95 | −95 | −95 | −95 | −95 | −95 |
| $M_f$, °C. | −100 | −100 | −100 | −100 | −100 | −100 | −100 |
| $A_s$, °C. | −56 | −56 | −56 | −56 | −56 | −56 | −56 |
| $A_{50}$, °C. | −40 | −40 | −40 | −40 | −40 | −40 | −40 |
| $A_f$, °C. | −27 | −27 | −27 | −27 | −27 | −27 | −27 |
| $A_{50}'$—$M_{50}$, °C. | 89 | 124 | 140 | 148 | 153 | 145 | 153 |
| $A_{50}$—$M_{50}$, °C. | 55 | 55 | 55 | 55 | 55 | 55 | 55 |
| $A_s'$—$M_s$, °C. | 76 | 117 | 131 | 140 | 144 | 124 | 145 |
| $A_s$—$M_s$, °C. | 34 | 34 | 34 | 34 | 34 | 34 | 34 |

[a]enlarged in liquid nitrogen (−196° C.)
[b]enlarged in −90° C. alcohol
[c]enlarged in −70° C. alcohol
[d]enlarged at 0° C.
[e]enlarged in −90° C. alcohol; reenlarged at 20° C.

It also can be seen that the width of the hysteresis has now been increased to 124° C. from 55° C. and the operating range ($A_s'$-$M_s$) has been increased to 117° C. By enlarging the ring 16.2% $A_s$ has now been temporarily raised to 41° C. with the width of the hysteresis now being 140° and the operating range now being 131° C.

It is believed that to have the most commercially practical alloy it is necessary to have an hysteresis width of greater than about 125° C. with ambient or room temperature somewhere in the middle of that hysteresis so as to allow a substantial leeway on either side of room temperature for temperature excursions. Strictly speaking, it would be most preferred if the $A_s'$ could be raised to about 50° C.

The first three samples enlarged at 5.2, 12.1, and 16.2% were enlarged in liquid nitrogen which is substantially below $M_s$. If the samples were now enlarged in −90° C. alcohol, which is at the $M_s$ temperature, it can be seen that the austenite transition temperatures have been raised to higher values than when enlarged in liquid nitrogen. By comparison, the $A_s'$ temperatures have been raised from 41° to 50° C. While this increase is not of great magnitude it is nevertheless important.

It is most preferred that the temperature of deformation be above $M_s$. The importance of this limitation is illustrated in the next sample which was deformed at −70° C. (compared to an $M_s$ of −90° C.). It can be seen that $A_s'$, and $A_{50}'$-$M_{50}$ and $A_s'$-$M_s$ have all been increased more than any of the previous samples.

The next sample was enlarged at 0° C.. While it can be seen that the hysteresis has been expanded, the effect of the expansion of the hysteresis has not been as great as when it was enlarged in −90° C. alcohol or −70° C. alcohol since $A_s'$ has only been raised to 34° C.

The previously stated results have been obtained by expanding the hysteresis through overdeforming of the alloy so as to impart nonrecoverable strain, removing the stress and then storing the alloy at a temperature less than $A_s'$.

The process may be varied somewhat so as to give equally dramatic results. Thus a sample may be overdeformed at low temperatures such as −90° C. in alcohol to stabilize the martensite at or near room temperature. When the stress is removed there will be an elastic springback of about 4%. Now if the alloy is redeformed at 20° C. to the same amount of overdeformation, 16.2%, and the stress removed, it can be seen in the last column of Table 3 that the austenite transition temperatures have been raised to even higher values when compared to a single expansion in −90° C. alcohol. Thus, $A_s'$ has been moved from 50° C. to 55° C. Again, while this increase in $A_s'$ may appear to be a small amount of temperature increase it is nevertheless of great importance. One easy way to accomplish this process is to deform the ring on a mandrel and then let the ring and mandrel warm to room temperature.

The nickel/titanium/niobium ternary alloys are preferred alloys due to their ready susceptibility to expansion of the transformation hysteresis as illustrated above. Of all the ternary niobium alloys, those that are stable, have an $M_s$ greater than 0° C. and do not have an R phase are the most preferred. The R phase, as further discussed below, is a transitional phase between austenite and martensite. Since the R phase is not present, there is substantial uniformity in the martensite and austenite transformation temperatures from sample to sample. Alloys that are stable (i.e., exhibit temper stability) have an $M_s$ that does not change more than about 20° C. after annealing and water quenching and subsequent aging between 300° and 500° C.

EXAMPLES 4, 5, and 6

Commercially pure titanium, carbonyl nickel and amounts of vanadium, cobalt, and aluminum were weighed in proportions so as to give compositions of: 46 atomic percent nickel, 49 atomic percent titanium, and 5 atomic percent vanadium; 49 atomic percent nickel, 49 atomic percent titanium, and 2 atomic percent cobalt; and 50 atomic percent nickel, 48.5 atomic percent titanium, and 1.5 atomic percent aluminum. Each of the compositions was melted and 0.025-in.-thick strips prepared in the same way as that previously stated with respect to the binary.

After elongation, the stress was removed and the strip was heated unrestrained so as to effect recovery which was monitored and plotted as a function of temperature. When the transformation was complete, the sample was cooled and then reheated so as to complete the measurement of the martensite and austenite transformation temperatures before recovery and after recovery. In the case of the cobalt alloy, the martensite and austenite transformation temperatures were measured with a load of 20 ksi and then extrapolated to 0 ksi. The results are tabulated below in Tables 4, 5, and 6.

TABLE 4

| Nickel/Titanium/Vanadium Ternary (46/49/5) | % Elongation* | |
|---|---|---|
| | 5 | 16 |
| $A_s'$, °C. | −20 | 84 |
| $A_{50}'$, °C. | −17 | 95 |
| $A_f'$, °C. | −15 | 105 |
| $M_s$, °C. | −46 | 10 |
| $M_{50}$, °C. | −68 | −17 |
| $M_f$, °C. | −96 | −50 |
| $A_s$, °C. | −24 | 40 |
| $A_{50}$, °C. | −17 | 50 |
| $A_f$, °C. | −10 | 70 |
| $A_{50}'$—$M_{50}$, °C. | 51 | 112 |
| $A_{50}$—$M_{50}$, °C. | 51 | 67 |
| $A_s'$—$M_s$, °C. | 26 | 74 |
| $A_s$—$M_s$, °C. | 22 | 30 |

*elongated at −100° C.

Figure 5:
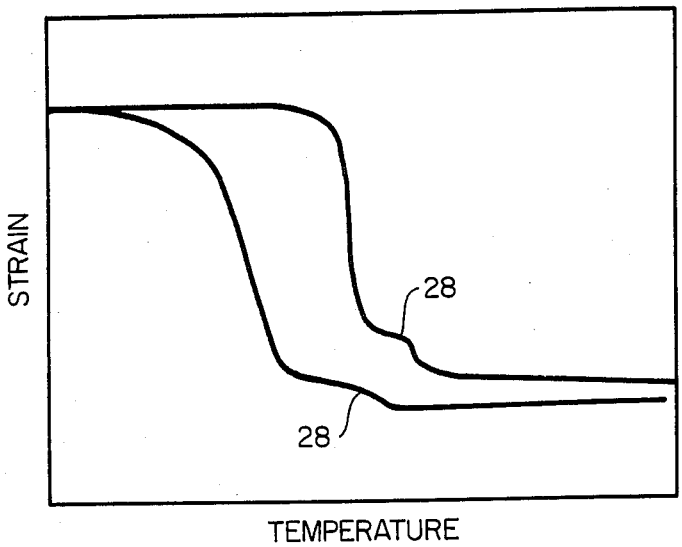
FIG. 5 is a schematical transformation hysteresis curve for a nickel/titanium/vanadium alloy after recovery of a 5% deformation and illustrating the presence of the R phase.
Figure 6:
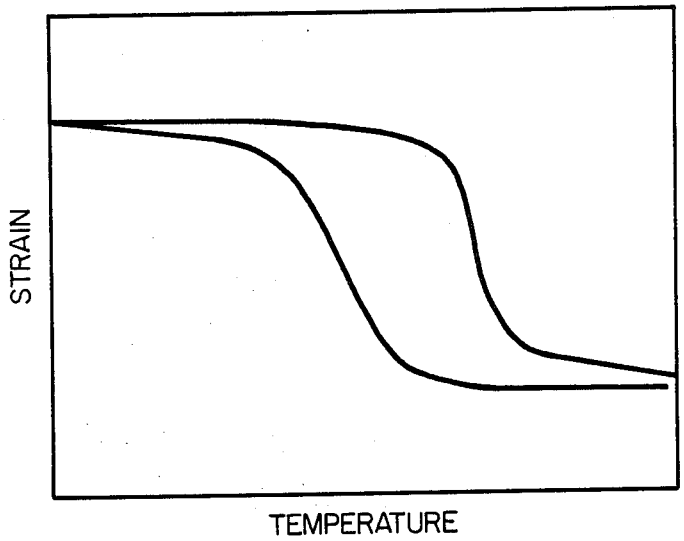
FIG. 6 is a schematical transformation hysteresis curve for a nickel/titanium/vanadium alloy after recovery of a 16% deformation and illustrating the absence of the R phase.

Referring to Table 4, the large discrepancy between the martensite and austenite transformation temperatures at 5 and 16%, respectively, is believed due to the interference 5 of the R-phase. Referring to FIG. 5, the presence of the R phase 28 os most noticeable on the austenite leg of the transformation hysteresis for the alloy deformed 5%. As stated previously the R phase is a transitional phase between the austenite and martensite and has a structure different than either. The effect of the R phase is to depress the austenite and martensite transformation temperatures. FIG. 6 illustrates the transformation hysteresis curve for the same alloy, but after recovering from 16% deformation. The R phase is noticeably absent. The austenite and martensite transformation temperatures in FIG. 6 are also noticeably higher.

Referring again to Table 4, it can be seen that a 5% deformation has little effect on the expansion of the hysteresis. Thus, $A_s'$ minus $M_s$ and $A_s$ minus $M_s$ are substantially the same. This is not the case after 16% deformation wherein the transformation hysteresis has been noticeably enlarged.

The results in Table 5 are similar to those in Table 4 in that a 5% deformation (no nonrecoverable strain) had little effect on the expansion of the transformation hysteresis whereas a 16% deformation (substantial nonrecoverable strain) had a marked effect on the expansion of the transformation hysteresis.

The change in the recovered martensite and austenite transformation temperatures between the 5% and 16% deformations is again believed due to the interference of the R phase in the sample deformed 5%.

TABLE 5

| Nickel/Titanium/Cobalt Ternary (49/49/2) | % Elongation* | |
|---|---|---|
| | 5 | 16 |
| $A_s'$, °C. | −81 | −54 |
| $A_{50}'$, °C. | −76 | −36 |
| $A_f'$, °C. | −71 | −18 |
| $M_s$, °C.[a] | −119 | −145 |
| $M_{50}$, °C.[a] | −141 | −160 |
| $M_f$, °C.[a] | −155 | −175 |
| $A_s$, °C.[a] | −85 | −100 |
| $A_{50}$, °C.[a] | −75 | −90 |
| $A_f$, °C.[a] | −67 | −80 |
| $A_{50}'$—$M_{50}$, °C. | 65 | 124 |
| $A_{50}$—$M_{50}$, °C. | 66 | 70 |
| $A_s'$—$M_s$, °C. | 38 | 91 |
| $A_s$—$M_s$, °C. | 34 | 45 |

*elongated at −100° C.
[a]extrapolated to 0 ksi load from 20 ksi load

TABLE 6

| Nickel/Titanium/Aluminum Ternary (50/48.5/1.5) | | |
|---|---|---|
| | % Elongation* | |
| | 5 | 16 |
| $A_s'$, °C. | −16 | 20 |
| $A_{50}$, °C. | −12 | 29 |
| $A_f'$, °C. | −6 | 42 |
| $M_s$, °C. | −67 | −72 |
| $M_{50}$, °C. | −84 | −104 |
| $M_f$, °C. | −108 | −122 |
| $A_s$, °C. | −24 | −32 |
| $A_{50}$, °C, | −12 | −20 |
| $A_f$, °C. | 0 | 3 |
| $A_{50}'$—$M_{50}$, °C. | 72 | 133 |
| $A_{50}$—$M_{50}$, °C. | 72 | 84 |
| $A_s'$—$M_s$, °C. | 51 | 92 |
| $A_s$—$M_s$, °C. | 43 | 40 |

*elongated at −100° C.

Referring now to Example 6 and Table 6, the sample deformed 16%, and thus having substantial nonrecoverable strain, shows a marked expansion of the transformation hysteresis (as in the previous two examples) whereas the sample deformed at 5% shows essentially no expansion of the transformation hysteresis.

Again, the interference of the R phase has manifested itself by depressing the martensite and austenite transformation temperatures in the sample deformed 5%.

It bears repeating here that the lack of utility of shape memory alloys has resulted at least in substantial part from the fact that the alloys cannot be deformed and then stored at room temperature. The present invention has solved all the problems of the prior art and has now resulted in an alloy and article which at least in the case of the most preferred niobium ternary alloy can be deformed and stored at room temperature or at least can be deformed in cold temperatures but can be stored and shipped at room temperature without the provision of cold storage procedures.

It can be appreciated that while this invention is most advantageous with respect to those alloys having an enlarged hysteresis with its middle near room temperature, it is within the scope of the invention to apply the teachings of this invention to other alloys as well, as illustrated in the above examples.

It can also be appreciated that the expansion of the transformation hysteresis will be more dramatic in some alloys than in others. This conclusion becomes apparent when comparing the transformation hysteresis expansion of the binary alloy with the transformation hysteresis expansion of the most preferred niobium ternary alloy.

Finally, it can be appreciated that while the samples in the above examples were deformed by application of a tensile stress, the objects of the invention can be fully achieved by application of a compressive stress.

It will be obvious to those skilled in the art having regard to this disclosure that other modifications of this invention beyond those embodiments specifically described here may be made without departing from spirit of the invention. Accordingly, such modifications are considered within the scope of the invention as limited solely by the appended claims.

We claim:

1. A method of processing a nickel/titanium-based shape memory alloy having a transformation hysteresis defined by $M_s$, $M_f$, $A_s$, and $A_f$ temperatures, the method consisting essentially of:

overdeforming the alloy, isothermally, at a temperature that is less than about the maximum temperature at which martensite can be stress-induced, by applying a continously increasing stress sufficient to cause nonrecoverable strain in the alloy so as to temporarily expand the transformation hysteresis by elevating the $A_s$ and $A_f$ temperatures to $A_s'$ and $A_f'$, respectively, so that the temperature difference between $A_s'$ and $M_s$ is greater than the temperature difference between $A_s$ and $M_s$; and storing the alloy at a temperature between $A_s$ and $A_s'$.

2. The method of claim 1 further consisting essentially of the step of removing the stress.

3. The method of claim 1 wherein in overdeforming the alloy, a stress is applied sufficient to cause at least one percent of nonrecoverable strain in the alloy.

4. The method of claim 3 wherein the overdeforming temperature is greater than $M_s$.

5. A method of processing a nickel/titanium-based shape memory alloy having a transformation hysteresis defined by $M_s$, $M_f$, $A_s$, and $A_f$ temperatures, the method consisting essentially of:

overdeforming the alloy, isothermally, at a temperature which is less than about the maximum temperature at which martensite can be stress-induced, by applying a continuously increasing stress sufficient to cause nonrecoverable strain in the alloy wherein the transformation hysteresis is temporarily expanded by elevating the $A_s$ and $A_f$ temperatures to $A_s'$ and $A_f'$, respectively, so that the temperature difference between $A_s'$ and $M_s$ is greater than the temperature difference between $A_s$ and $M_s$.

6. The method according to claim 5 further consisting essentially of the step of removing the stress.

7. The method according to claim 5 wherein in the step of overdeforming the alloy, a stress is applied sufficient to cause at least one percent of nonrecoverable strain in the alloy.

8. The method according to claim 5 further consisting essentially of the step of storing the alloy at a temperature less than about $A_s'$.

9. The method according to claim 5 wherein the overdeforming temperature is greater than $M_s$.

10. The method according to claims 1 or 5 wherein the overdeforming takes place at a first temperature and further consisting essentially of the step of raising the temperature of the alloy to a second temperature while maintaining the applied strain.

11. The method according to claim 10 wherein the second temperature is room temperature.

12. The method according to claims 2 or 6 wherein the overdeforming takes place at a first temperature and further consisting essentially of the step of overdeforming the alloy, isothermally, a second time by applying a continuously increasing stress sufficeint to cause nonrecoverable strain in the alloy wherein the second overdeforming takes place at a second temperature different from the first temperature.

13. The method according to claim 12 wherein the second temperature is room temperature.

14. The method according to claims 1 or 5 further consisting essentially of the step of heating the alloy to a temperature greater than about $A_s'$ so as to effect at least partial recovery of the alloy.

15. The method according to claim 14 wherein the heating temperature is greater than about $A_f'$.

16. The method according to claims 1 or 5 wherein the nickel/titanium-based shape memory alloy has an $M_s$ less than about 0° C.

17. The method according to claims 1 or 5, wherein the nickel/titanium-based shape memory alloy is stable, does not contain an R phase, and has an $M_s$ less than about 0° C.

18. The method according to claims 1 or 5 wherein the nickel/titanium-based shape memory alloy is a binary.

19. The method according to claims 1 or 5 wherein the nickel/titanium-based shape memory alloy is at least a ternary.

20. The method of claims 1 or 5 wherein the ternary nickel/titanium-based shape memory alloy consists essentially of nickel, titanium and at least one other element selected from the group consisting of iron, cobalt, vanadium, aluminum, and niobium.

21. The method according to claim 20 wherein the ternary nickel/titanium-based shape memory alloy consists essentially of nickel, titanium, and niobium.

22. A nickel/titanium-based shape memory alloy article having a transformation hysteresis defined by $M_s$, $M_f$, $A_s$, and $A_f$ temperatures, the article processed by the method consisting essentially of:

forming the alloy into an article;

overdeforming the article, isothermally, at a temperature that is less than about the maximum temperature at which martensite can be stress-induced, by applying a continuously increasing stress sufficient to cause nonrecoverable strain in the article so as to temporarily expand the transformation hysteresis by elevating the $A_s$ and $A_f$ temperatures to $A_s'$ and $A_f'$, respectively, so that the temperature difference between $A_s'$ and $M_s$ is greater than the temperature difference between $A_s$ and $M_s$; and storing the alloy at a temperature between $A_s$ and $A_s'$.

23. The article processed by the method of claim 22 further consisting essentially of the step of removing the stress.

24. The article processed by the method of claim 22 wherein in overdeforming the article a stress is applied sufficient to cause at least one percent of nonrecoverable strain in the article.

25. The article processed by the method of claim 22 wherein the overdeforming temperature is greater than $M_s$.

26. A nickel/titanium-based shape memory alloy article having a transformation hysteresis defined by $M_s$, $M_f$, $A_s$, and $A_f$ temperatures, the article processed by the method consisting essentially of:

forming the alloy into an article;

overdeforming the article, isothermally, at a temperature which is less than about the maximum temperature at which martensite can be stress-induced, by applying a continously increasing stress sufficient to cause nonrecoverable strain in the article wherein the transformation hysteresis is temporarily expanded by elevating the $A_s$ and $A_f$ temperatures to $A_s'$ and $A_f'$, respectively, so that the temperature difference between $A_s'$ and $M_s$ is greater than the temperature difference between $A_s$ and $M_s$.

27. The article processed by the method according to claim 26 further consisting essentially of the step of removing the stress.

28. The article processed by the method according to claim 26 wherein in the step of overdeforming the article a stress is applied sufficient to cause at least one percent of nonrecoverable strain in the article.

29. The article processed by the method according to claim 26 further consisting essentially of the step of storing the article at a temperature less than about $A_s'$.

30. The article processed by the method according to claim 26 wherein the overdeforming temperature is greater than $M_s$.

31. the articel processed by the method according to claims 22 or 26 wherein the overdeforming takes place at a first temperature and further consisting essentially of the step of raising the temperature of the article to a second temperature while maintaining the applied strain.

32. The article processed by the method according to claim 31 wherein the second temperature is room temperature.

33. The article processed by the method according to claims 23 or 27 wherein the overdeforming takes place at a first temperature and further consisting essentially of the step of overdeforming the article, isothermally, a second time by applying a continously increasing stress sufficient to cause nonrecoverable strain in the article wherein the second overdeforming takes place at a second temperature different from the first temperature.

34. The article processed by the method according to claim 33 wherein the second temperature is room temperature.

35. The article processed by the method according to claims 22 or 26 further consisting essentially of the step of heating the article to a temperature greater than about $A_s'$ so as to effect at least partial recovery of the article.

36. The article processed by the method according to claim 35 wherein the heating temperature is greater than about $A_f'$.

37. The article processed by the method according to claims 22 or 26 wherein the nickel/titanium-based shape memory alloy has an Mphd s less than about 0°C.

38. The article processed by the method according to claims 22 or 26 wherein the nickel/titanium-based shape memory alloy is stable, does not contain an R phase, and has an $M_s$ less than about 0° C.

39. The article processed by the method according to claims 22 or 26 wherein the nickel/titanium-based shape memory alloy is a binary.

40. The article processed by the method according to claims 22 or 26 wherein the nickel/titanium based shape memory alloy is at least a ternary.

41. The article processed by the method of claim 22 or 26 wherein the ternary nickel/titanium-based shape memory alloy consists essentially of nickel, titanium and at least one other element selected from the group consisting of iron, cobalt, vanadium, aluminum, and niobium.

42. The article processed by the method according to claim 41 wherein the ternary nickel/titanium-based shape memory alloy consists essentially of nickel, titanium, and niobium.

43. The article processed by the method according to claims 22 or 26 wherein the article is a coupling.

44. The method according to claims 1, 5, 22 or 26 consisting essentially of the further step of selecting an alloy having an $A_s$ below room temperature wherein after deformation $A_s'$ is above room temperature.

45. The method according to claims 1, or 5, consisting essentially of the further step of subsequently overdeforming the alloy isothermally at a temperature below $A'_s$ by applying a continuously increasing stress so as to increase $A'_s$.

46. The method according to claims 22 or 26 consisting essentially of the further step of subsequently overdeforming the article isothermally at a temperature below $A'_s$ by applying a continuously increasing stress so as to increase $A'_s$.

47. A method of processing a nickel/titanium-based shape memory alloy having a transformation hysteresis defined by $M_s$, $M_f$, $A_s$, and $A_f$ temperatures, the method comprising:

processing the alloy so as to initiate the shape memory effect, wherein said processing consists essentially of:

overdeforming the alloy at a temperature which is less than about maximum temperature at which martensite can be stress-induced by applying a stress sufficient to cause nonrecoverable strain in the alloy wherein the transofrmation hysteresis is temporarily expanded by elevating the $A_s$ and $A_f$ temperatures to $A_s'$ and $A_f'$, respectively, so that the temperature differences between $A'_s$ and $M_s$ is greater than the temperature difference between $A_s$ and $M_s$; and avoiding heating above $A'_s$ prior to any subsequent overdeforing steps.

48. A method of processing a nickel/titanium-based shape memory alloy having a transformation hysteresis defined by $M_s$, $M_f$, $A_s$, and $A_f$ temperatures, the method comprising:

processing the alloy so as to initiate the shape memory effect, wherein said processing consists essentially of:

only overdeforming the alloy, wherein the overdeforming comprises overdeforming the alloy at a temperature which is less than about the maximum temperature at which martensite can be stress-induced by applying a stress sufficient to cause nonrecoverable strain in the alloy wherein the transformation hysteresis is temporarily expanded by elevating the $A_s$ and $A_f$ temperatures to $A_s'$ and $A_f$, respectively, so that the temperature difference between $A_s'$ and $M_s$ is greater than the temperature difference between $A_s$ and $M_s$.

49. The method according to claims 47 or 48 further comprising the step of storing the alloy at a temperature less than about $A'_s$.

50. The method according to claims 47 or 48 further comprising the step of heating the alloy to a temperature greater than about $A'_s$ so as to effect at least partial recovery of the alloy.

51. The method according to claim 50 wherein the heating temperature is greater than about $A'_f$.

52. A method of processing a nickel/titanium-based shape memory alloy article having a transformation hysteresis defined by $M_s$, $M_f$, $A_s$, and $A_f$ temperatures, the method comprising:

forming the alloy into an article;

processing the article so as to initiate the shape memory effect, wherein said processing consists essentially of:

overdeforming the alloy at a temperature which is less than about maximum temperature at which martensite can be stress-induced by applying a stress sufficient to cause nonrecoverable strain in the article wherein the transformation hysteresis is temporarily expanded by elevating the $A_s$ and $A_f$ temperatures to $A_s'$ and $A_f'$, respectively, so that the temperature differences between $A'_s$ and $M_s$ is greater than the temperature difference between $A_s$ and $M_s$; and avoiding heating above $A'_s$ prior to any subsequent overdeforming steps.

53. A method of processing a nickel/titanium-based shape memory alloy article having a transformation hysteresis defined by $M_s$, $M_f$, $A_s$, and $A_f$ temperatures, the method comprising:

forming the alloy into an article;

processing the article so as to initiate the shape memory effect, wherein said processing consists essentially of:

only overdeforming the article, wherein the overdeforming comprises overdeforming the article at a temperature which is less than about the maximum temperature at which martensite can be stress-induced by applying a stress sufficient to cause nonrecoverable strain in the article wherein the transformation hysteresis is temporarily expanded by elevating the $A_s$ and $A_f$ temperatures to $A_s'$ and $A_f'$, respectively, so that the temperature difference between $A_s'$ and $M_s$ is greater than the temperature difference between $A_s$ and $M_s$.

54. The method according to claims 52 or 53 further comprising the step of storing the article at a temperature less than about $A'_s$.

55. The method according to claims 52 or 53 further comprising the step of heating the article to a temperature greater than about $A'_s$ so as to effect at least partial recovery of the article.

56. The method according to claim 55 wherein the heating temperature is greater than about $A'_f$.

* * * * *